US005508469A

United States Patent [19]

Kunimoto et al.

[11] Patent Number: 5,508,469

[45] Date of Patent: Apr. 16, 1996

[54] MUSICAL TONE SYNTHESIZING APPARATUS CAPABLE OF CHANGING MUSICAL PARAMETERS IN REAL-TIME

[75] Inventors: Toshifumi Kunimoto; Masahiro Kakishita, both of Hamamatsu, Japan

[73] Assignee: Yamaha Corporation, Japan

[21] Appl. No.: 122,885

[22] Filed: Sep. 16, 1993

[30] Foreign Application Priority Data

Sep. 18, 1992 [JP] Japan ..... 4-250184

[51] Int. Cl.[6] ..... G10H 7/00

[52] U.S. Cl. ..... 84/603; 84/617

[58] Field of Search ..... 84/600–603, 622, 84/659, 617, 655

[56] References Cited

U.S. PATENT DOCUMENTS

| | | | |
|---|---|---|---|
| 4,747,332 | 5/1988 | Uchiyama et al. . | |
| 4,984,276 | 1/1991 | Smith . | |
| 5,248,844 | 9/1993 | Kunimoto | 84/622 |
| 5,383,386 | 1/1995 | Kudo et al. | 84/622 |

FOREIGN PATENT DOCUMENTS 64-12399 2/1989 Japan .

*Primary Examiner*—William M. Shoop, Jr.
*Assistant Examiner*—Jeffrey W. Donels
*Attorney, Agent, or Firm*—Graham & James

[57] ABSTRACT

A musical tone synthesizing apparatus comprises a digital signal processor (i.e., DSP), a main memory and a sub memory. The main memory stores main instructions, while the sub memory stores sub instructions. In accordance with the main instructions and the sub instructions, the DSP performs several kinds of arithmetical operations in a time-division manner. Herein, the main instructions embody algorithms representing a sound source which contains a non-linear table. The contents of the non-linear table represents a non-linear characteristic of a musical instrument to be simulated. Values to be stored in the non-linear table are calculated in accordance with a predetermined mathematical computation utilizing a series expansion, a recurrence formula and the like. By rewriting the contents of the non-linear table, a non-linear characteristic to be applied to musical tone signals is altered in real time. Incidentally, the sub instructions are used to perform several kinds of operations such as an operation of rewriting the contents of the non-linear table and/or a low-pass filtering operation.

6 Claims, 15 Drawing Sheets

MUSICAL TONE SYNTHESIZING APPARATUS CAPABLE OF CHANGING MUSICAL PARAMETERS IN REAL-TIME

BACKGROUND OF THE INVENTION

1. Field of the Invention

The present invention relates to a musical tone synthesizing apparatus which is suitable for use in a sound source simulating a sound-production mechanism of a non-electronic musical instrument.

2. Prior Art

Conventionally, the sound source simulating the sound-production mechanism of the non-electronic musical instrument provides a closed-loop circuit containing a non-linear table which performs a predetermined non-linear function.

FIG. 21 is a block diagram showing a conventional musical tone synthesizing circuit embodying an algorithm which simulates a string-striking operation of a hammer in a piano. For convenience' sake, this musical tone synthesizing circuit will be denoted as a first musical tone synthesizing circuit. In this first musical tone synthesizing circuit, the sound-production mechanism of the non-electronic musical instrument such as the piano is accurately simulated so as to synthesize and produce musical tones which are close to real sounds actually produced from the non-electronic musical instrument. More specifically, the first musical tone synthesizing circuit provides a waveguide 1 and an excitation circuit 2. Herein, the waveguide 1 simulates an effect of a sound-producing element (e.g., a string) of the non-electronic musical instrument, while the excitation circuit 2 simulates an effect of a performing element (e.g., a hammer) which imparts a vibration to the sound-producing element.

The above-mentioned waveguide 1 provides delay circuits 3 and filters 4. Delay characteristics of the delay circuits 3 and frequency characteristics of the filters 4 are determined to be identical to those of the sound-producing elements of the nonelectronic musical instrument. On the other hand, the excitation circuit 2 provides a non-linear table 5 which functions to create an excitation signal corresponding to an energy which is imparted to the sound-producing element by the performing element.

The excitation signal produced from the non-linear table 5 is supplied to the waveguide 1 through adders 6. This excitation signal circulates through the waveguide 1, from which a certain musical tone signal is obtained.

The non-linear function stored in the non-linear table 5 can be expressed as follows, with respect to an input δ:

$$f(\delta)=1-e^{-\gamma\delta} \text{ when } \delta\geqq 0 \text{ or } 0 \text{ when } \delta\leqq 0 \quad (1)$$

This non-linear function can be represented by a curve shown in FIG. 22. Herein, a functional output begins to rise up when an input is equal to "0", and then, the functional output is gradually raised up to be close to an output level "1". The algorithm representing the non-linear function is performed by a digital signal processor (i.e., DSP) which performs a fixed-point arithmetical calculations. In order to perform such fixed-point arithmetical calculations in real time, non-linear values are calculated in advance; these values are stored in a memory of the DSP in form of a table; and then, the DSP refers to this table when actually performing a musical tone synthesis.

FIG. 23 is a block diagram showing another type of the conventional musical tone synthesizing circuit (hereinafter, referred to as a second musical tone synthesizing circuit) which embodies an algorithm of a non-linear portion of a single-reed instrument. In FIG. 23, a slit function table 10 stores a non-linear slit function, of which functional output represents a degree of an open/close state of a reed with respect to input parameters such as a blowing pressure PRESS and an embouchure signal EMB. Incidentally, a reed dynamics filter receiving the embouchure signal EMB is provided to simulate the dynamic characteristic of the reed. The functional output of the slit function represents a degree of a closing state of the reed or whether or not the reed is perfectly opened. When an inclination of a functional curve is made sharp, the reed is operated to be merely opened or closed. In this case, a tone quality of the musical tone to be synthesized becomes monotonous. On the other hand, when the inclination of the functional curve is made gradual, the reed is operated to be slowly opened or closed so that there exists a transient state while the reed is opened or closed. In this case, a waveform of the musical tone to be synthesized becomes round or a tone quality of the musical tone to be synthesized is made soft.

A graham function table 11 stores a non-linear graham function, of which functional output represents an amount of an air volume flow to be flown into a pipe of an instrument with respect to a pressure difference between a pipe inside pressure "qh" and the blowing pressure PRESS. If there is no pressure difference between the pipe inside pressure qh and the blowing pressure PRESS, It can be obviously stated that no air is flown into or flown from the pipe of the instrument. On the other hand, the air is flown into the pipe when the blowing pressure PRESS is higher than the pipe inside pressure qh, whereas the air is flown outside from the pipe when the pipe inside pressure qh is higher than the blowing pressure PRESS. When an inclination of a functional ,curve representing the graham function is made sharp, the air should be rapidly flown into or flown from the pipe even if a pressure difference is small. Thus, the tone quality of the musical tone should become intense. When the inclination of the functional curve of the graham function is made gradual, the air flow becomes delicate, so that a delicate tone color can be obtained.

The above-mentioned graham function can be represented by a following equation with respect to an input x.

$$G_f(x)=-\text{sign}\,(x)(\gamma x)^{1/2} \quad (2)$$

An example of the functional curve of the graham function represented by the above equation is shown in FIG. 24(A). FIG. 24(B) shows an example of the functional curve of the aforementioned slit function. In the second musical tone synthesizing circuit, each of functional calculations of the graham function and slit function is carried out in advance, so that a calculation result is stored in the memory of the DSP. Thereafter, when synthesizing the musical tones, the DSP refers to the table.

Meanwhile, the non-linear function employed in the first musical tone synthesizing circuit is provided to simulate the string-striking operation of the hammer, while this non-linear function further relates to an elastic coefficient (or spring coefficient) of a felt adhered to the hammer which collides with the string. Therefore, if the non-linear function is performed in a step-by-step manner, the elastic coefficient of the felt becomes effective at a moment when the felt of the hammer comes in contact with the string.

In the real instrument, however, the felt itself must be deformed when the felt collides with the string, so that the elastic coefficient of the felt may become effective gradually. In other words, when employing a hard felt for the hammer, higher-order overtones are contained in the musical tones to be produced, resulting that the musical tones may be sounded hard. Or, when employing a soft felt for the hammer, the musical tones may be sounded soft.

In order to accurately embody the above-mentioned characteristic of the hammer, it is necessary to alter the inclination of the functional curve of the non-linear function at its rising portion. In other words, the inclination of the functional curve should be made sharp when simulating the behavior of the hard felt, while the inclination should be made gradual when simulating the behavior of the soft felt.

In order to do so, the parameter 7 in the aforementioned equation is changed. However, in the first musical tone synthesizing circuit, it is impossible to change the parameter 7 in real time while the functional output is gradually raised up to the functional level "1". In short, there is a problem in that a simulation for the behavior of the hammer of the real instrument cannot be sufficiently carried out.

Even in the second musical tone synthesizing circuit, it is impossible to change each of the parameters in real time, in other words, it is impossible to change the inclination of the functional curve at its rising portion or a waveshape of the functional curve in real time. Similarly, during a real-time musical performance, it is impossible to assign the inclination of the functional curve of the slit function and the waveshape of the functional curve of the non-linear function (e.g., graham function) to manual-operable members and change them. Thus, there is another problem in that a simulation for the open/close state of the reed and a simulation for a flowing behavior of the air volume flow cannot be sufficiently carried out.

SUMMARY OF THE INVENTION

Accordingly, it is an object of the present invention to provide a musical tone synthesizing apparatus which can change the parameters used for synthesizing the musical tones in real time so as to eventually synthesize the musical tones full of variety.

Basically, the present invention relates to a musical tone synthesizing apparatus which provides a closed-loop circuit including a non-linear table and also provides a signal processing portion for repeatedly performing arithmetical calculations and/or logical operations required for synthesizing the musical tones. According to a feature of the present invention, the signal processing portion performs a first algorithmic operation and a second algorithmic operation. Herein, the first algorithmic operation is required for synthesizing the musical tones and is completely carried out in each period. On the other hand, the second algorithmic operation is completed during plural periods. This second algorithmic operation is divided into plural operations, each of which is carried out in each of plural periods. Thus, in each period, the signal processing portion carries out the first algorithmic operation and a divided operation belonging to the second algorithmic operation in a time-division manner.

BRIEF DESCRIPTION OF THE DRAWINGS

Further objects and advantages of the present invention will be apparent from the following description, reference being had to the accompanying drawings wherein the preferred embodiment of the present invention is clearly shown.

In the drawings.

DESCRIPTION OF THE PREFERRED EMBODIMENT

Figure 1:
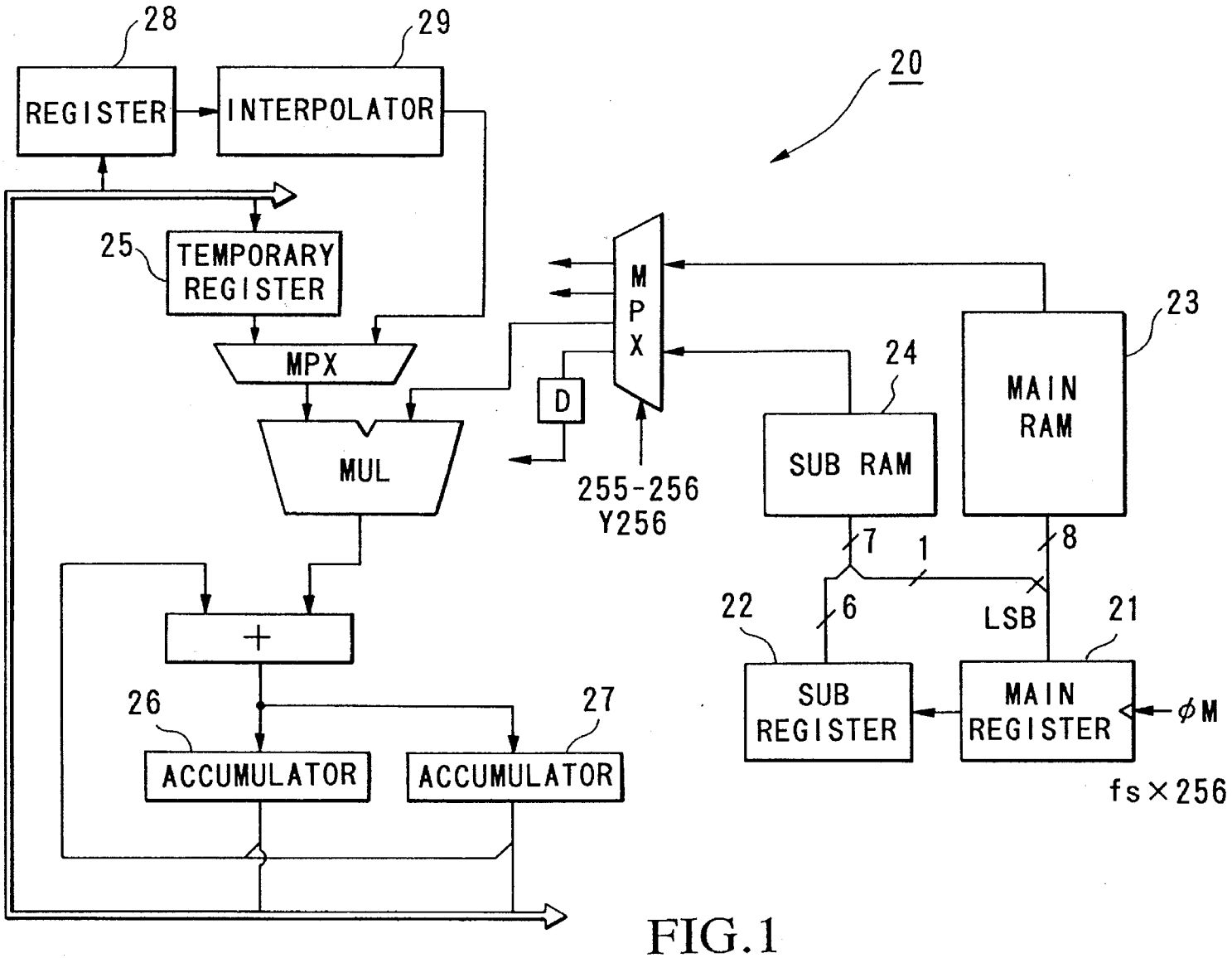
FIG. 1 is a block diagram showing an electronic configuration of a musical tone synthesizing apparatus according to an embodiment of the present invention.
Figure 23:
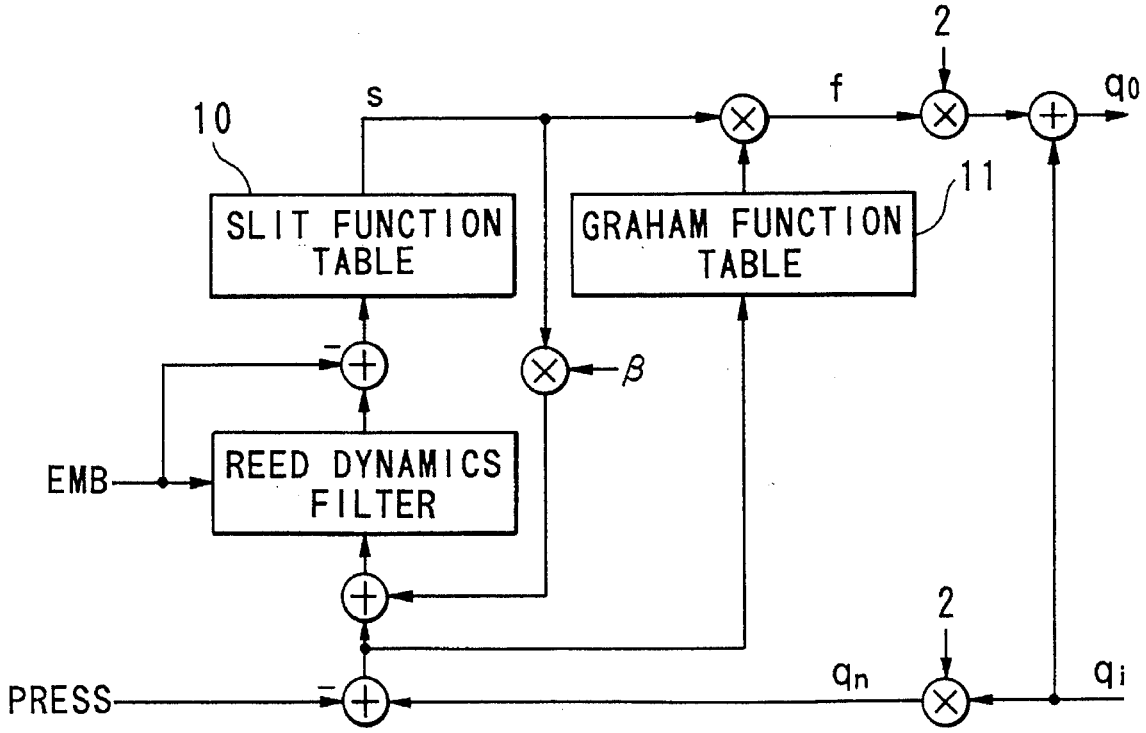
FIG.23(PRIOR ART)
FIG. 23 is a block diagram showing another conventional example of a musical tone synthesizing circuit embodying an algorithm simulating a non-linear portion of a single-reed instrument.

FIG. 1 is a block diagram showing an electronic configuration of an essential part of a musical tone synthesizing apparatus according to an embodiment of the present invention. More specifically, FIG. 1 shows an algorithmic configuration of the digital signal processor (i.e., DSP) employed for the musical tone synthesizing apparatus. Incidentally, a whole algorithmic configuration of the musical tone synthesizing apparatus is similar to that shown in FIGS. 21 or 23, hence, a detailed description thereof will be omitted. A feature of the present invention lies in that the contents of the non-linear tables (containing the slit function table and the graham function table described before) are rewritten in real time by the arithmetical operations performed by the DSP. In the present embodiment, the other algorithmic operations required for the musical tone synthesizing apparatus can be also performed by the DSP as shown in FIG. 1. In FIG. 1, "MUL" designates a multiplier, while "MPX" designates a multiplexer. Since 256 steps are performed in one cycle in the circuitry shown in FIG. 1, the multiplexer is changed over when completing 255 (or 256) steps so that the subside portion is accessed.

[A] Configuration of Embodiment

In FIG. 1, the illustration of the configuration of the DSP is simplified in order to make a description for the DSP clearer. A DSP 20 shown in FIG. 1 is configured to perform main instructions and sub instructions. A main-side algorithm corresponding to the main instructions contains several kinds of filtering operations and effect operations other than arithmetical operations for the sound source. A sub-side algorithm corresponding to the sub instructions contains calculations for signals each having a relatively small bandwidth in addition to calculations for envelopes and low-frequency oscillations. In the case of the so-called physical model of sound source, calculations for several kinds of parameters regarding the operations of the reed are continuously carried out at a low sampling rate, for example. Further, calculations for the bowed instrument must be performed with respect to signals each having a relatively low frequency band. For this reason, calculations using the low sampling rate is economical. On the other hand, the other signal processings (e.g., tone envelope generating processing) in which MIDI signals (where MIDI denotes a standard for Musical Instrument Digital Interface) supplied to several kinds of controllers are held or interpolated are normally carried out at an intermediate sampling rate.

In order to do so, the DSP 20 provides a main register 21 and a main random-access memory (i.e., main RAM) 23 for the execution of the main instructions, while a sub register 22 and a sub RAM 24 are provided for the execution of the sub instructions. Other hardware elements can be commonly shared by the main instructions and the sub instructions. Data can be transferred between a main-side algorithmic portion and a sub-side algorithmic portion by means of a temporary register 25. Each of the main register 21 and the sub register 22 can be operated independently. Moreover, there are provided a main accumulator 26 and a sub accumulator 27. Since the accumulators 26 and 27 can work independently, the DSP 20 can work as if an arithmetic and logic unit (i.e., ALU) is provided for each of the main-side algorithmic portion and the sub-side algorithmic portion (hereinafter, simply referred to as a main portion and a sub portion respectively). Incidentally, the ALU contains an adder and a multiplier.

Figure 2:
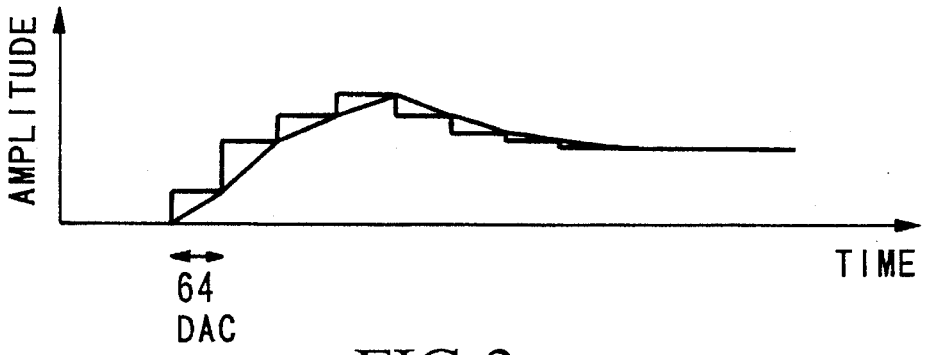
FIG. 2 is a graph showing an envelope waveform which is obtained by performing an interpolation.

Meanwhile, there occurs a problem when transferring the data between the main portion and the sub portion, in which values representing waveforms produced by an envelope generator and a low-frequency oscillator cannot be used directly in a sound-source algorithm performed in the main portion. Because, such values are too discrete, resulting that an interpolation must be required. For this reason, as shown in FIG. 1, there are provided a register 28 and an interpolator 29. FIG. 2 shows an interpolation applied to the signals which are produced from the envelope generator when performing the sub instructions. Thus, the waveform should be made smooth at a sampling rate fs, otherwise noises may be caused. More specifically, if the waveform which is not smooth at the sampling rate fs is used, due to effects of variations of envelope amplitudes and tone colors, the noises are caused when carrying out the sound-source algorithm.

Figure 3:
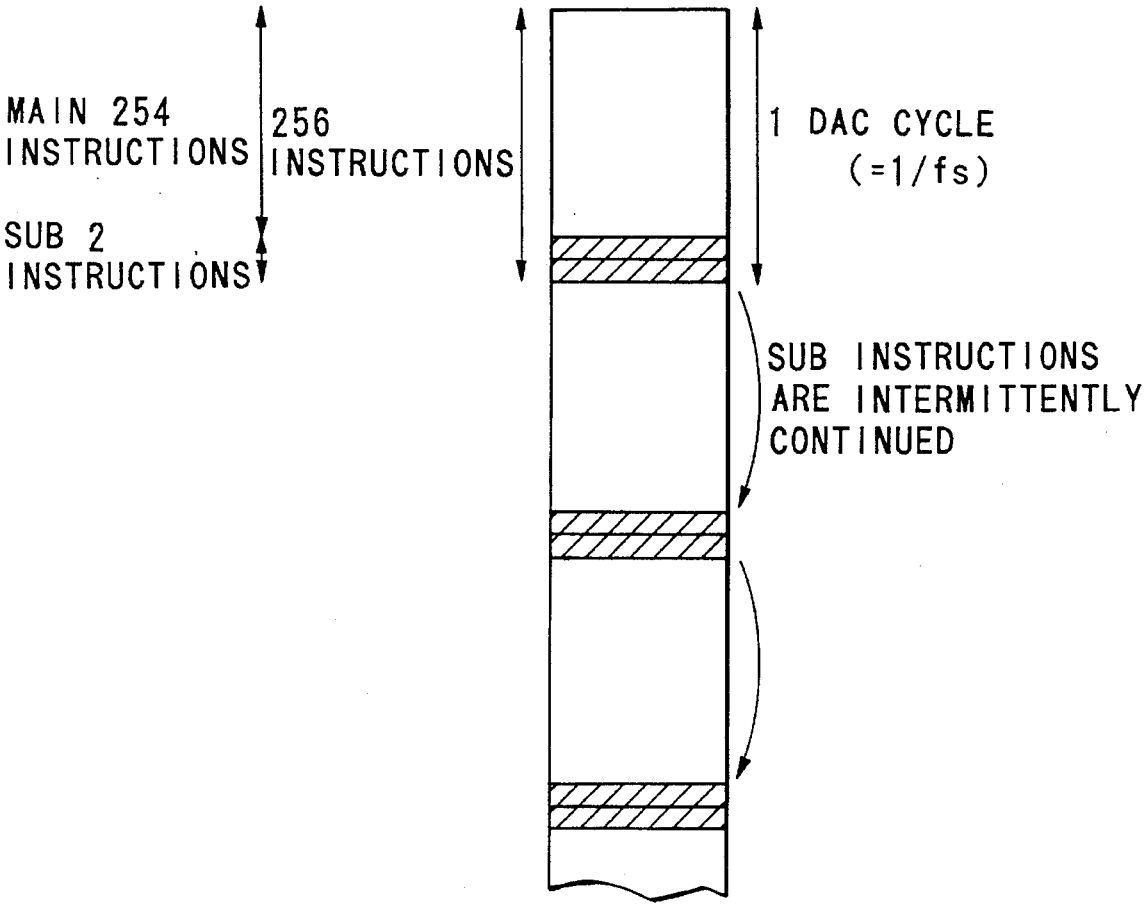
FIG. 3 is a drawing showing an execution manner of programs containing main instructions and sub instructions.

FIG. 3 shows an example of a processing procedure for performing the instructions for the DSP. Herein, the sampling period of the DSP 20 is determined responsive to an execution period in which a predetermined number of instructions are normally carried out. For example, it is possible to employ a certain system in which two hundreds and fifty six instructions are carried out in one digital-to-analog conversion cycle (which corresponds to one sampling period, hereinafter, simply referred to as 1 DAC cycle). In the case where the signal processing corresponding to the envelope generator or the low-frequency oscillator is required to be performed in the DSP which is used as the sound source, a certain number of instructions within the above-mentioned 256 instructions (or 256 steps) are assigned for such signal processing, and they are collected together for 64 DAC cycles, by which a large number of instructions collected together for 64 DAC cycles are performed at once. In FIG. 3, 2 out of 256 instructions are assigned for the envelope generator and the low-frequency oscillator (hereinafter, a pair of these instructions is represented by a symbol "SUB"), while 254 instructions remained (hereinafter, these instructions are represented by a symbol "MAIN") are assigned for the algorithmic operations. Therefore, the signal processing corresponding to the envelope generator and the low-frequency oscillator is performed one time within 64 DAC cycles. In other words, 128 instructions (which corresponds to a result of multiplication for multiplying "2" by "64") are provided for the signal processing corresponding to the envelope generator and the low-frequency oscillator. In the present embodiment, the calculations of the DSP are carried out by use of the fixed-point technique, 16-bit system and 2's complement (ranging from "–1" to "0.999 . . .").

[B] Algorithms

Next, the description will be given with respect to the algorithms of the DSP, each of which is provided to simulate the representative sound-production mechanism of the non-electronic musical instrument.

(1) String-Striking Algorithm

Herein, the description will be given with respect to the algorithm which simulates a sound-production mechanism of a string-striking-type instrument.

In order to embody the string-striking algorithm, some conditions are required. For example, it is necessary to provide a non-linear table for 2048 data. By referring to the non-linear table, the algorithmic operations are carried out. Further, 160 steps of the algorithmic operations are required for 1 DAC cycle. Under the consideration of these conditions, a number of steps which can be used for the non-linear table within 1 DAC cycle is limited to "96". However, such small number of steps cannot respond to all of the data stored in the non-linear table. Thus, in order to cope with such limitation, 96 steps are used for the calculations required for four non-linear table in 1 DAC cycle, for example. In order to perform the calculations with respect to 2048 data stored in the non-linear table, 512 DAC cycles are necessary. In other words, the contents of the non-linear table is renewed one time in 10.24 ms.

① Method for making a non-linear table by use of a series-expansion technique

In order to satisfy the above conditions, a method employing a series-expansion technique can be used for making the non-linear table.

A non-linear characteristic of the string-striking algorithm may be expressed by the aforementioned equation (1). In the equation (1), an exponential term "exp(−γx)" can be expressed as follows, by using the series-expansion technique:

$$e^{-\gamma x}=1-\gamma x/1!+(\gamma x)^2/2!-(\gamma x)^3/3!+(\gamma x)^4/4!+ \quad (3)$$

When using first five terms of the above equation (3), the equation (1) can be rewritten as follows, with respect to a condition of $x \geqq 0$:

$$f(x)\approx 1-\gamma x/1!-(\gamma x)^2/2!+(\gamma x)^3/3!-(\gamma x)^4/4! \quad (4)$$

Figure 4:
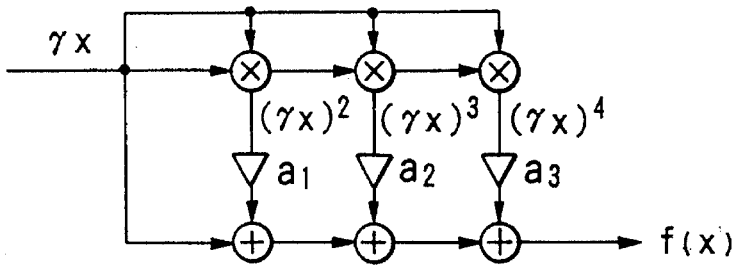
FIG. 4 is a block diagram showing an algorithmic configuration embodying a series-expansion expression.
Figure 5:
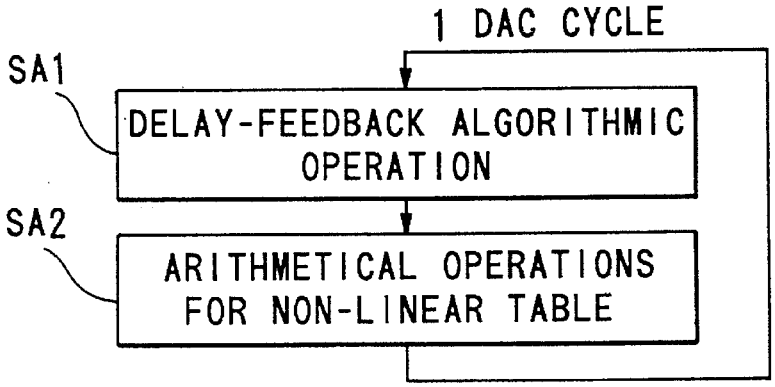
FIG. 5 is a flowchart showing a main routine, to be executed in one digital-to-analog conversion cycle, which is used to perform a predetermined algorithm.
Figure 6:
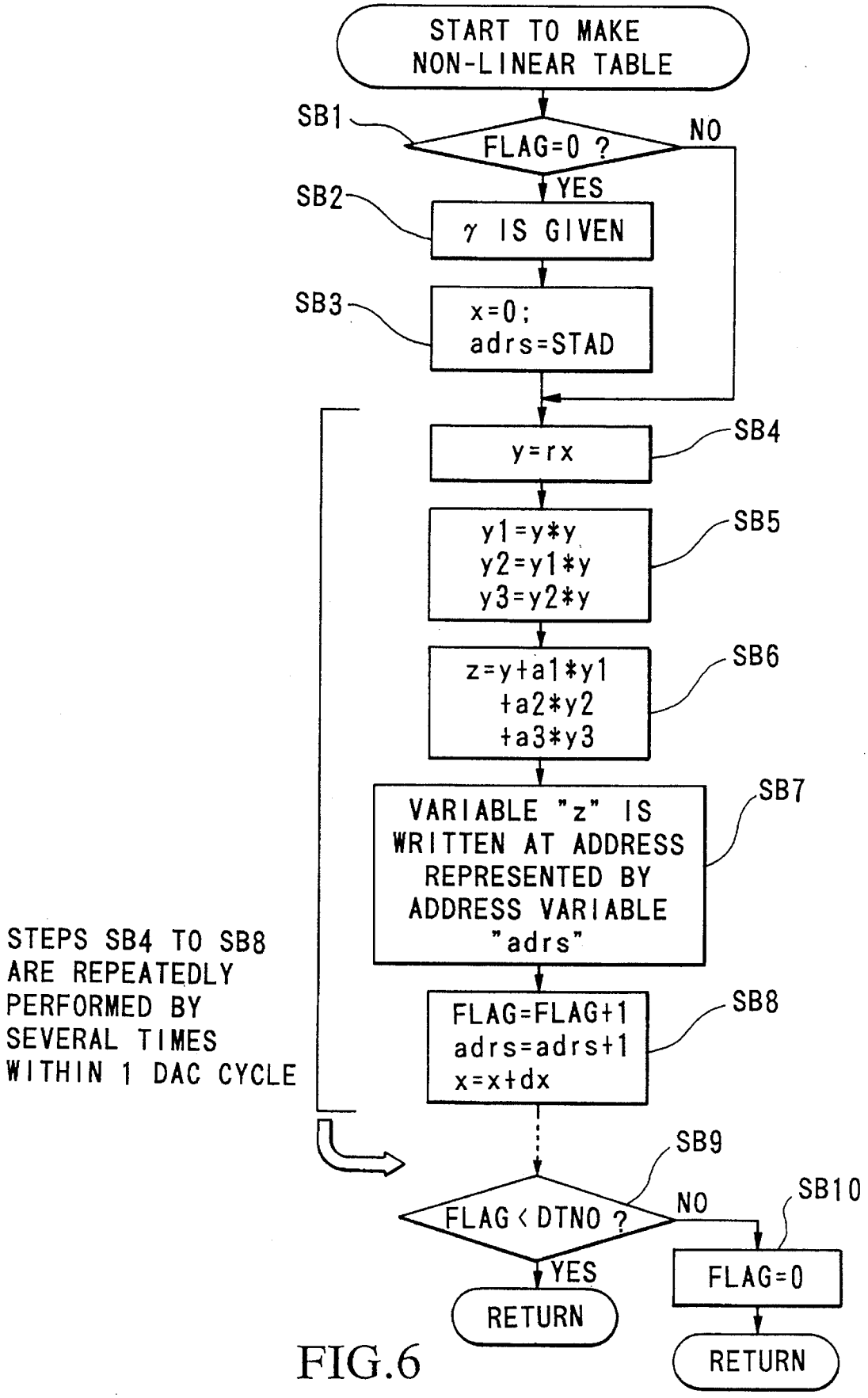
FIG. 6 is a flowchart showing processes which are required for performing an algorithm as shown in FIG. 4 when making a nonlinear table.

When a parameter γ is given from a computer externally provided, an algorithmic configuration as shown in FIG. 4 is designed for the algorithmic operation expressed by the above equation (4). In this configuration, three multipliers are provided, to which three coefficients a1, a2 and a3 are respectively given. Herein, a1=COOOH (=−0.5); a2=1555H (=⅙, approximately); and a3=FAA6H (=−1/24, approximately). FIGS. 5 and 6 are flowcharts which are provided to make the non-linear table by use of the algorithmic configuration shown in FIG. 4.

Figure 21:
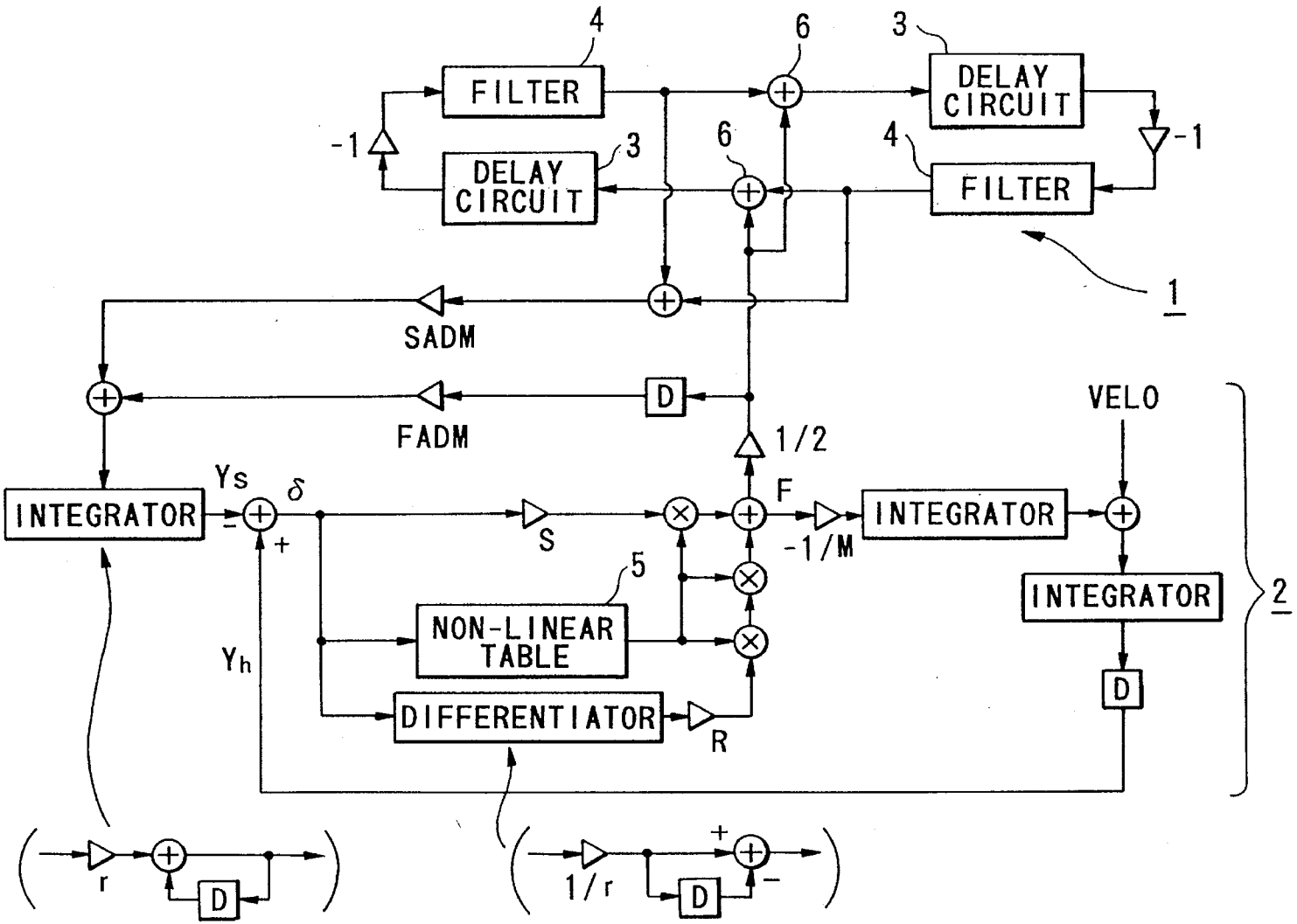
FIG.21 (PRIOR ART)
FIG. 21 is a block diagram showing a conventional example of a musical tone synthesizing circuit embodying an algorithm representing a string-striking operation of a hammer.
Figure 22:
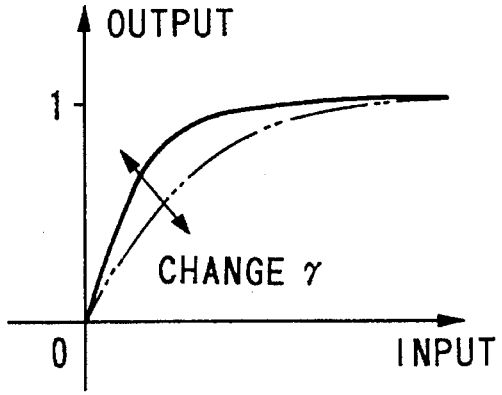
FIG. 22 is a graph showing an input/output characteristic of a non-linear table used in the circuitry shown in FIG. 21.

FIG. 5 is a flowchart showing a main routine containing processes which are performed in 1 DAC cycle. In first step SA1 of this flowchart, predetermined calculations are performed so as to embody the delay feedback operation as shown in FIG. 21. In next step SA2, other calculations are performed so as to embody the functions of the aforementioned non-linear table. FIG. 6 is a flowchart showing a procedure in which the above calculations are performed so as to form the non-linear table.

In first step SB1 of the flowchart shown in FIG. 6, it is judged whether or not a flag represented by a symbol "FLAG" is set at "0". If a result of the judgement of this step SB1 is "YES", the processing proceeds to a next step SB2. In step SB2, the coefficient γ is given from the computer externally provided. In next step SB3, a variable "x" is set at "0", while a start address "STAD" representing a write address for the non-linear table is set as an address variable "adrs".

If the judgement result of step SB1 is "NO", or when completing the process of step SB3, the processing proceeds to step SB4. In step SB4, a result of a multiplication in which the coefficient γ is multiplied by the variable x is set as a variable "y". In step SB5, a product of a multiplication "y*y" is set as a variable "y1"; a product of a multiplication "y1*y" is set as a variable "y2"; and a product of a multiplication "y2*y" is set as a variable "y3". In step SB6, a result of an arithmetical operation represented by a mathematical expression of "y+a1*y1+a2*y2+a3*y3" is set as a variable "z".

In step SB7, the above-mentioned variable z is written in the non-linear table at an address designated by the foregoing address variable adrs. In step SB8, both of the flag FLAG and the address variable adrs are incremented by one, while the variable x is increased by "dx". The provision of the process of step SB8 enables the present system to prepare for the calculations to be performed with respect to a next address.

The above-mentioned processes of steps SB4 to SB8 are repeatedly performed within 1 DAC cycle. When completing these processes by a predetermined number of times in 1 DAC cycle, the processing advances to step SB9 in which it is judged whether or not the flag FLAG is smaller than a variable "DTN0" representing a size of the non-linear table. If a result of the judgement of step SB9 is "NO", the processing proceeds to step SB10 in which the flag FLAG is set at "0". Thus, it is declared that the predetermined calculations are completely performed. Then, the processing returns back to the main routine shown in FIG. 5.

In contrast, when the judgement result of step SB9 is "YES", it is indicated that the predetermined calculations are not completed. Thus, the processing directly returns back to the main routine without clearing the flag FLAG. In this case, if the processing proceeds to the routine shown in FIG. 6 again, the calculations are carried out on the basis of the values γ and x which are obtained by performing the processes of steps SB2 and SB3. Thus, the aforementioned processes are repeatedly performed until the judgement result of step SB9 turns to "NO".

By carrying out the above-mentioned arithmetical operations, the contents of the non-linear table corresponding to the algorithmic configuration shown in FIG. 4 is rewritten.

② Method for making a non-linear table by use of a recurrence formula

Next, the description will be given with respect to a method for making the non-linear table by use of the recurrence formula. At first, a following equation (5) is obtained by use of the aforementioned equation (3) representing the non-linear characteristic of the string-striking algorithm.

$$f(nT)=1-e^{-\gamma nT}=1-(e^{-\gamma T})^n \quad (5)$$

Terms used in the above equation (5) are respectively expressed by other expressions as follows:

$$A=e^{-\gamma T} \quad (6)$$

$$F(n)=f(nT) \quad (7)$$

$$G(n)=A^n \quad (8)$$

Thus, the equation (5) can be rewritten as follows:

$$F(n)=1-G(n) \quad (9)$$

The above term "G(n)" can be expressed by a following recurrence formula.

$$G(n)=A\cdot G(n-1) \quad (10)$$

Figure 7:
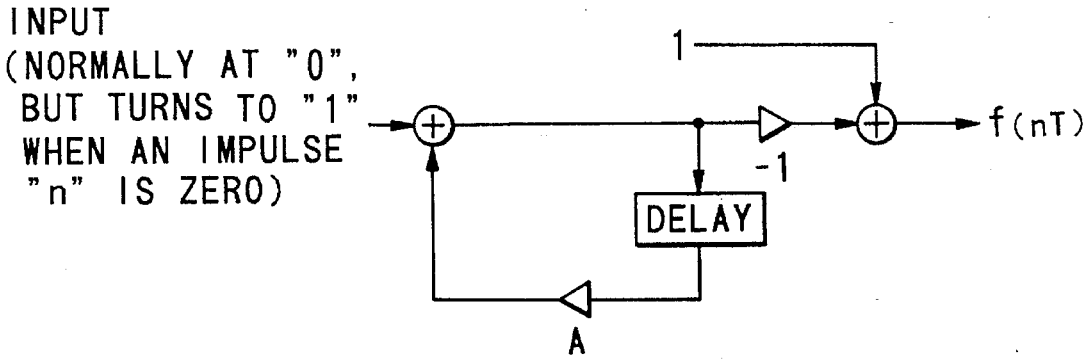
FIG. 7 is a block diagram showing an algorithmic configuration embodying a recurrence formula.
Figure 8:
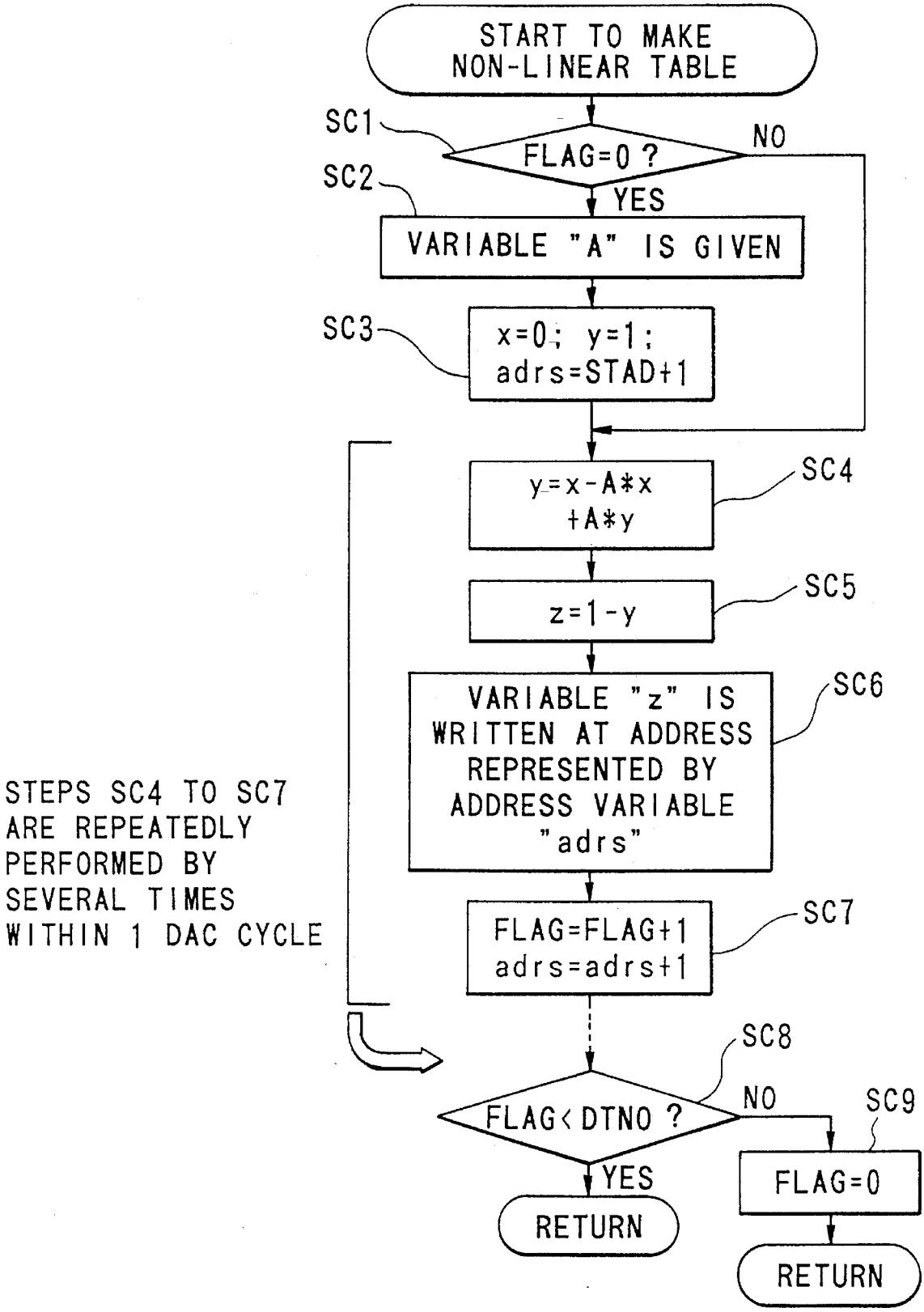
FIG. 8 is a flowchart showing processes which are required for performing an algorithm as shown in FIG. 7 when making a nonlinear table.

FIG. 7 is a block diagram showing an algorithmic configuration which is used to calculate the above mathematical expressions (9) and (10). An Input applied to the circuitry shown in FIG. 7 is normally set at "0". However, only when an impulse is at zero level (i.e., n=0), this input value is set at "1". By applying such input value to the circuitry shown in FIG. 7, it is possible to obtain a series of desired functional values. FIG. 8 is a flowchart showing a procedure for making the non-linear table on the basis of the algorithmic configuration shown in FIG. 7.

In fist step SC1 of the flowchart shown in FIG. 8, it is judged whether or not a flag FLAG is set at "0". If a result of a judgement of step SC1 is "YES", the processing proceeds to step SC2. In step SC2, a variable "A" is newly given. In next step SC3, the variable x is set at "0"; the variable y is set at "1"; and the start address STAD representing the write address for the non-linear table is set as the address variable adrs.

If the judgement result of step SC1 is "NO", or when completing the process of step SC3, the processing proceeds to step SC4 in which a result of an arithmetical operation represented by a mathematical expression of "x–A*x+A*y" is set as the variable y. In step SC5, a result of a subtraction "1–y" is set as the variable z. In step SC6, the above variable z is written into the non-linear table at an address designated by the address variable adrs. In step SC7, both of the flag FLAG and the address variable adrs are incremented by one.

The above-mentioned processes of steps SC4 to SC7 are repeatedly performed within 1 DAC cycle. When completing these processes by a predetermined number of times within 1 DAC cycle, the processing advances to step SC8 in which it is judged whether or not the flag FLAG is smaller than the variable DTN0 representing the size of the non-linear table. If the judgement result of step SC8 is "NO", the processing proceeds to step SC9 in which the flag FLAG is set at "0" in order to declare that the predetermined calculations are completed. Then, the processing returns back to the main routine as shown in FIG. 5.

In contrast, if the judgement result of step SC8 is "YES", it is indicated that the predetermined calculations are not completed. In this case, the processing directly returns back to the main routine without clearing the flag FLAG. Thereafter, when the processing returns to the routine shown in FIG. 8, the predetermined calculations are performed on the basis of the values A and x which are obtained by carrying out the processes of steps SC2 and SC3. Thus, the processes are repeatedly performed until the judgement result of step SC8 turns to "NO".

By carrying out the above-mentioned arithmetical operations, it is possible to rewritten the contents of the non-linear table corresponding to the algorithmic configuration shown in FIG. 7.

③ Another method

Figure 9:
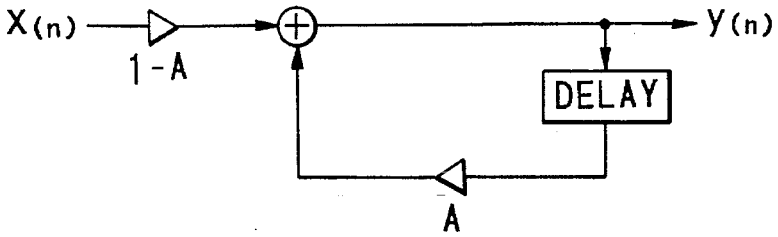
FIG. 9 is a block diagram showing another example of an algorithmic configuration embodying a predetermined function.

FIG. 9 is a block diagram showing another algorithmic configuration, to which a step function S(n) represented by a following expression is applied as an input.

$$S(n)=1 \text{ (where } n\geqq 0) \text{ or } 0 \text{ (where } n<0) \quad (11)$$

Then, an output of the algorithmic configuration shown in FIG. 9 is represented by a following expression.

$$y(n)=1-A^n \quad (12)$$

Figure 10:
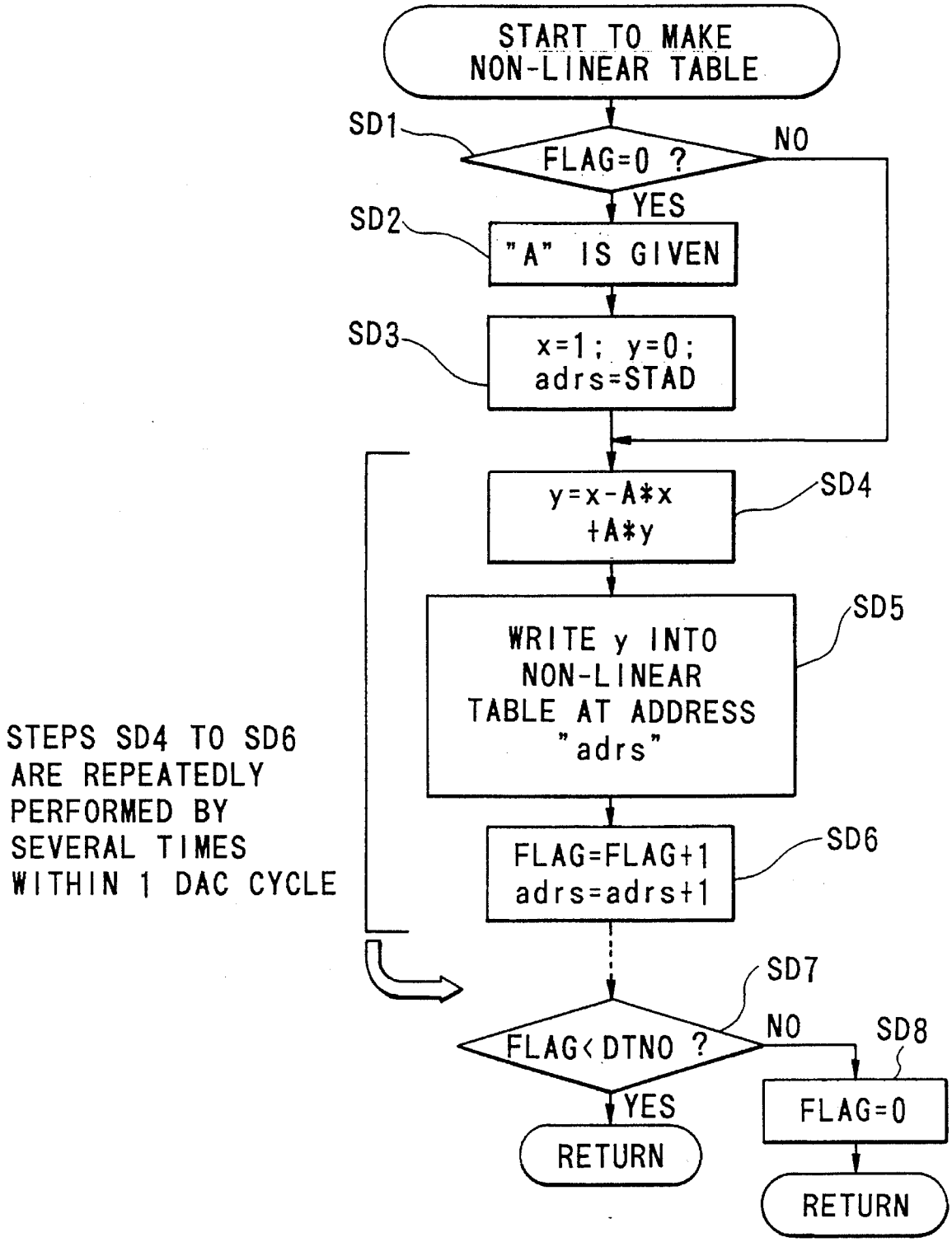
FIG. 10 is a flowchart showing processes which are required for performing an algorithm as shown in FIG. 9 when making a nonlinear table.

Thus, the algorithmic configuration shown in FIG. 9 can offer the function represented by the aforementioned equation (5). FIG. 10 is a flowchart showing a procedure by which the contents of the non-linear table is made by use of the algorithmic configuration shown in FIG. 9.

In first step SD1 in FIG. 10, it is judged whether or not a flag FLAG is set at "0". If a result of the judgement of step SD1 is "YES", the processing proceeds to step SD2 in which the variable A is given. In next step SD3, the variable x is set at "1"; the variable y is set at "0"; and the start address STAD representing the write address for the non-linear table is set as the address variable adrs.

In contrast, when the judgement result of step SD1 turns to "NO", or when the process of step SD3 is completed, the processing proceeds to step SD4 in which the variable y is set equal to a result of a calculation represented by a mathematical expression of "x–A*x+A*y". In step SD5, the variable y of which value is determined by the process of step SD4 is written into the non-linear table at an address represented by the address variable adrs. In step SD6, both of the flag FLAG and the address variable adrs are incremented by one.

The above-mentioned processes of steps SD4 to SD6 are repeatedly performed within 1 DAC cycle. When completing the processes in 1 DAC cycle, the processing advances to step SD7 in which it is judged whether or not the flag FLAG is smaller than the variable DTNO representing the size of the non-linear table. If a result of the judgement of step SD7 is "NO", the processing proceeds to step SD8. In step SD8, the flag FLAG is set at "0" so as to declare that the predetermined calculations are completed. Thereafter, the processing returns back to the main routine as shown in FIG. 5.

On the other hand, when the judgement result of step SD7 turns to "YES", it is indicated that the predetermined calculations are not completed. Thus, the processing directly returns back to the main routine without clearing the flag FLAG. Thereafter, when the processing returns to the routine shown in FIG. 10 again, the processes are carried out on the basis of the values A and x which are obtained by performing the processes of steps SD2 and SD3. These processes are repeatedly performed until the judgement result of step SD7 turns to "NO".

By performing the above-mentioned arithmetical operations, the contents of the non-linear table is rewritten in accordance with the algorithm as shown in FIG. 9.

In the objective function as represented by the foregoing equation (4), the functional output becomes close to an output level "1" when a certain time constant is given. In short, any kinds of the low-pass filters each of which has a certain order and a certain step response characteristic can be employed as the circuit element which embodies the above-mentioned function. In this case, an inclination of a functional curve can be altered by changing the time constant of the low-pass filter.

(2) Single-Reed Algorithm for Slit Function

Figure 11:
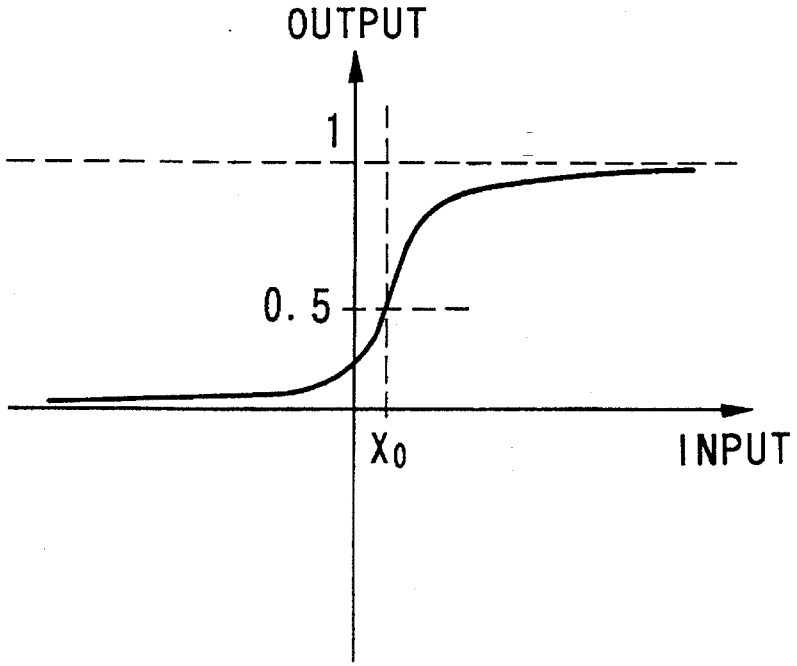
FIG. 11 is a graph showing a functional curve of a slit function.

Next, the description will be given with respect to an algorithm simulating the slit function which is used when analyzing the sound-production mechanism of the wind instrument. The slit function has a characteristic as shown by a graph of FIG. 24(B). However, the functional curve of the slit function can be drawn as shown in FIG. 11. For convenience' sake, this curve is divided into two parts with respect to an input "x0". At the input x0, an output level to be read from the functional curve is equal to 0.5. In a right-side portion of the functional curve, the functional output is gradually increased to an output level "1". In a left-side portion of the functional curve, the functional output is gradually decreased to an output level "0".

Figure 12:
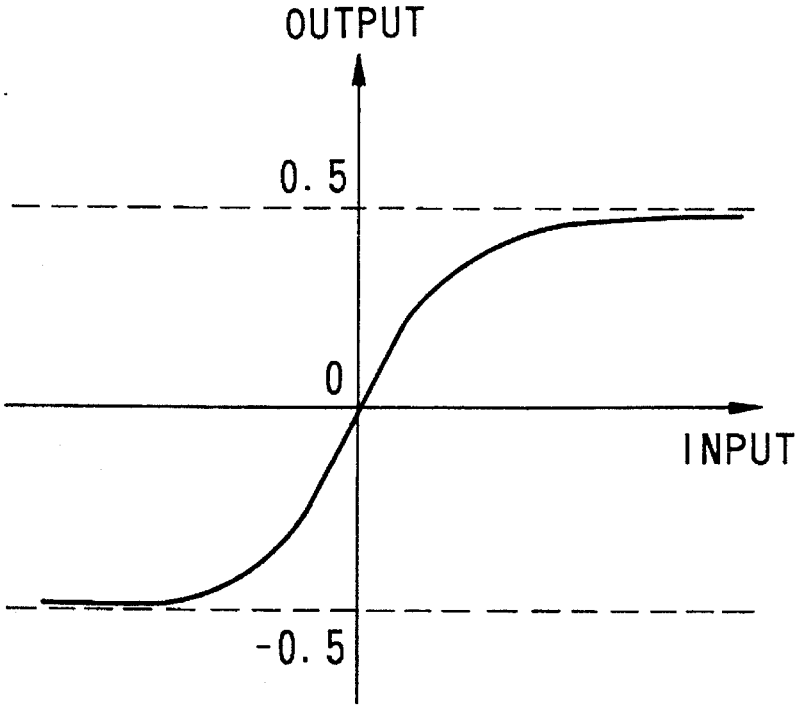
FIG. 12 is a graph showing a functional curve which is obtained by shifting the functional curve shown in FIG. 11.
Figure 13:
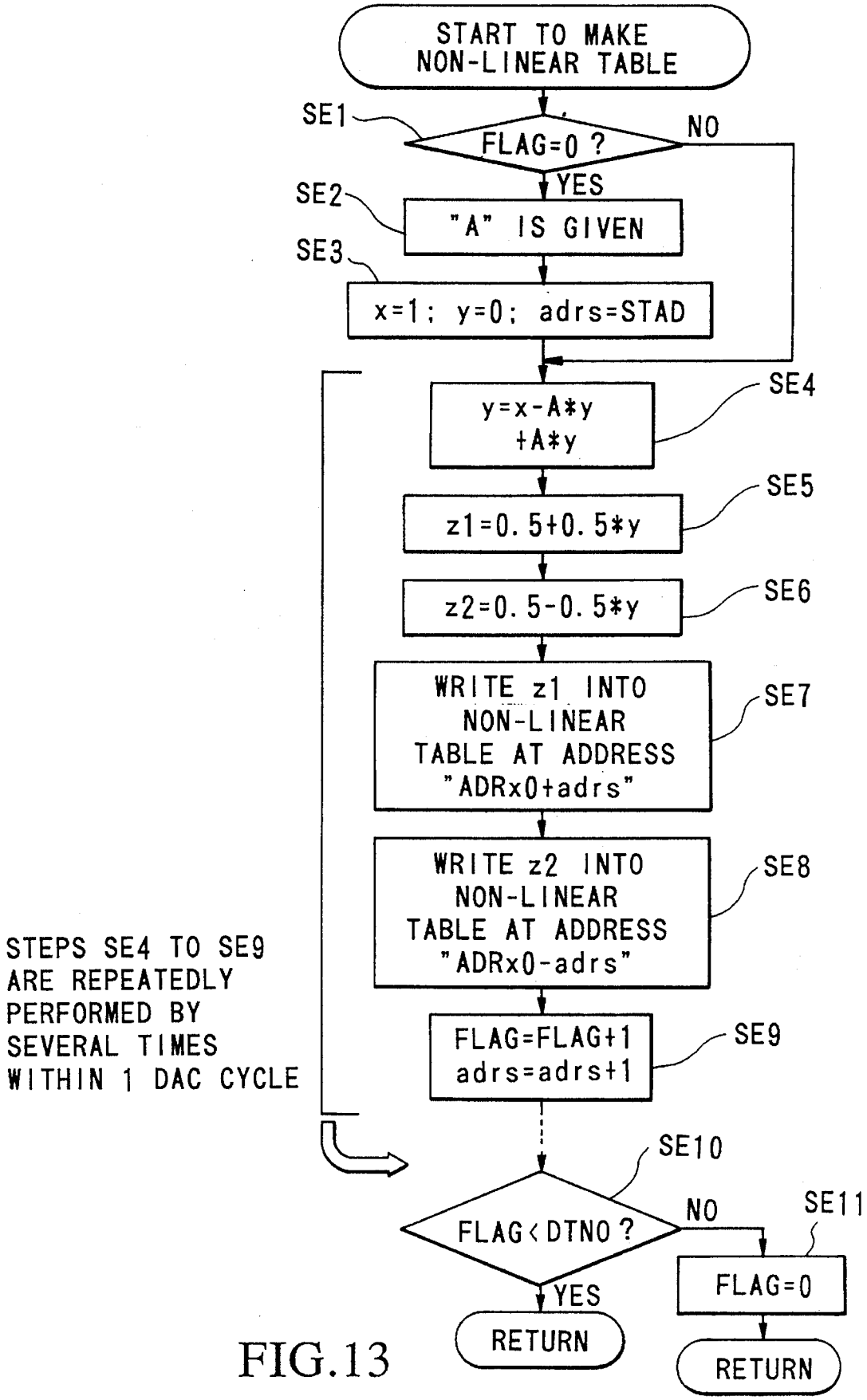
FIG. 13 is a flowchart showing processes which are required for performing an algorithm corresponding to a step function when making a non-linear table.

FIG. 12 is a graph showing a functional curve which is obtained by moving the functional curve shown in FIG. 11 such that its shape is symmetrical with respect to the origin. A part of the functional curve belonging to a first quadrant of the graph shown in FIG. 12 is symmetrical with another part of the functional curve belonging to a third quadrant with respect to the origin. Thus, based on the aforementioned series-expansion technique corresponding to the algorithmic configuration shown in FIG. 4 or the recurrence formula corresponding to the algorithmic configuration shown in FIG. 7 or 9, it is possible to form the non-linear table. As one example, the algorithmic configuration shown in FIG. 9 is chosen for describing a method to make the non-linear table. FIG. 13 is a flowchart showing a procedure by which the non-linear table is formed in response to the step response characteristic of the algorithm as shown in FIG. 9.

In first step SE1 in FIG. 13, it is judged whether or not the flag FLAG is set at "0". If a result of the judgement of step SE1 is "YES", the processing proceeds to step SE2 in which the variable A is given. In next step SE3, the variable x is set at "1"; the variable y is set at "0"; and the start address STAD is set as the address variable adrs.

If the judgement result of step SE1 is "NO", or when the process of step SE3 is completed, the processing proceeds to step SE4. In step SE4, a result of a calculation represented by a mathematical expression of "x–A*x+A*y" is set as the variable y. In step SE5, a result of a calculation represented by an expression of "0.5+0.5*y" is set as a variable z1. In step SE6, a result of a calculation represented by an expression of "0.5–0.5*y" is set as a variable z2. In step SE7, the above variable z1 is written into the non-linear table at an address designated by a result of a calculation represented by an expression of "ADRx0+adrs". Herein, the value ADRx0 represents an address corresponding to the aforementioned input value x0 shown in FIG. 11. In step SE8, the above variable z2 is written into the non-linear table at an address designated by a result of a calculation represented by an expression of "ADRx0–adrs". In step SE9, both of the flag FLAG and the address variable adrs are incremented by one.

The above-mentioned processes of steps SE4 to SE9 are repeatedly performed within 1 DAC cycle. Thus, the non-linear table is divided into two parts with respect to an address represented by an expression "ADRx0+STAD", wherein a first part contains results of the calculations to be performed with respect to the variable z2, while a second part contains results of the calculations to be performed with respect to the variable z1. When completing the processes in 1 DAC cycle, the processing advances to step SE10 in which it is judged whether or not the flag FLAG is smaller than a value DTN0 (representing a half size of the non-linear table). When a result of the judgement of step SE10 is "NO", the processing proceeds to step SE11. In step SE11, the flag FLAG is set at "0" so as to declare that the predetermined calculations are completed. Then, the processing returns back to the main routine as shown in FIG. 5.

On the other hand, when the judgement result of step SE10 is "YES", it is indicated that the predetermined calculations are not completed. In this case, the processing directly returns back to the main routine without clearing the flag FLAG. Thereafter, when the processing returns to the routine shown in FIG. 13 again, the foregoing processes are performed on the basis of the values A and x which are obtained by the processes of steps SE2 and SE3. The processes are repeatedly performed until the judgement result of step SE10 turns to "NO".

As described above, the above-mentioned arithmetical operations to be performed in the routine shown in FIG. 13 can offer the step response characteristic corresponding to the algorithmic configuration shown in FIG. 9.

(3) Single-Reed Algorithm for Graham Function

Figure 24A:
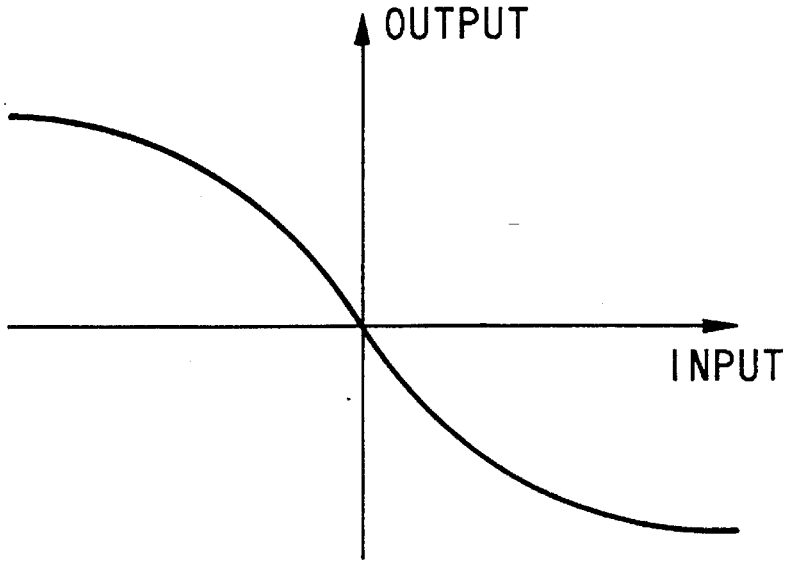
FIG. 24(A) is a graph showing a characteristic of a graham function used in the circuitry shown in FIG. 23.
Figure 24B:
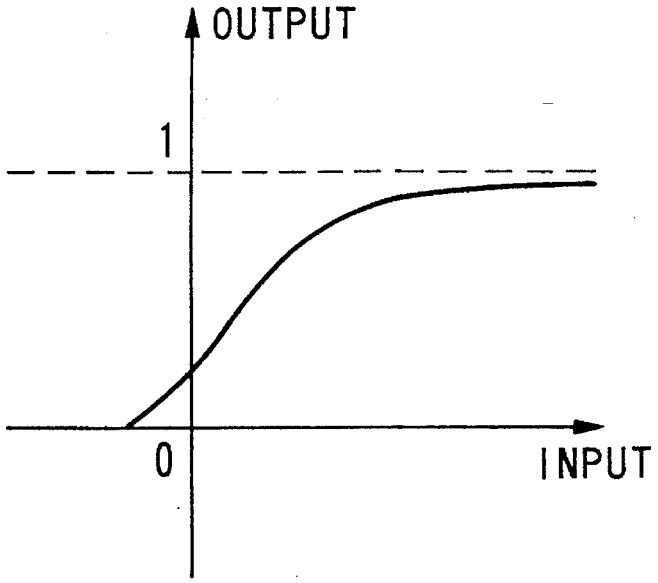
FIG. 24(B) is a graph showing a characteristic of a slit function used in the circuitry shown in FIG. 23.

Next, the description will be given with respect to an algorithm simulating the graham function which is used when analyzing the sound-production mechanism of the wind instrument. As described before, the graham function is expressed by the foregoing equation (2). The functional curve of the graham function has a shape which is symmetrical with respect to the origin as shown in FIG. 24(A). A part of the functional curve of which functional output corresponds to an input x (where $x \geqq 0$) can be expressed by a following equation (13).

$$G_f(x) = -(\gamma x)^{1/2} \tag{13}$$

As described before, both of the series-expansion technique and the recurrence-formula technique can be employed for making the non-linear table of which contents is expressed by the equation (13). Thus, these two methods will be described in turn.

① Method to make a non-linear table by the series-expansion technique

By replacing a term "γ x" by "(1–y)", the equation (13) can be rewritten as follows:

$$G_f(y) = -(1-y)^{1/2} \text{ (where } y \leqq 1) \tag{14}$$

By performing a series expansion on this equation (14), a series-expansion formula can be obtained. First five terms of the series-expansion formula can be represented as follows:

$$-G_f(y) = 1 + y/2 - y^2/8 + y^3/16 - 5/128 * y^4 \tag{15}$$

Figure 14:
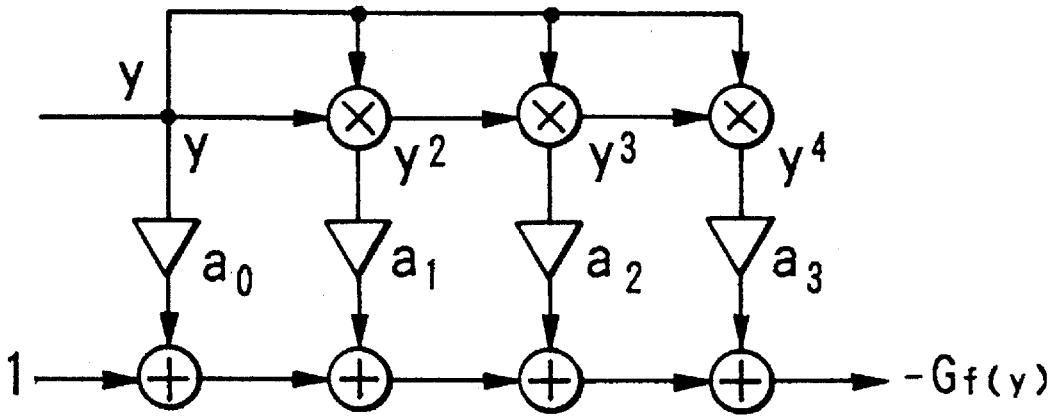
FIG. 14 is a block diagram showing an algorithmic configuration embodying a predetermined series-expansion expression representing a graham function.
Figure 15:
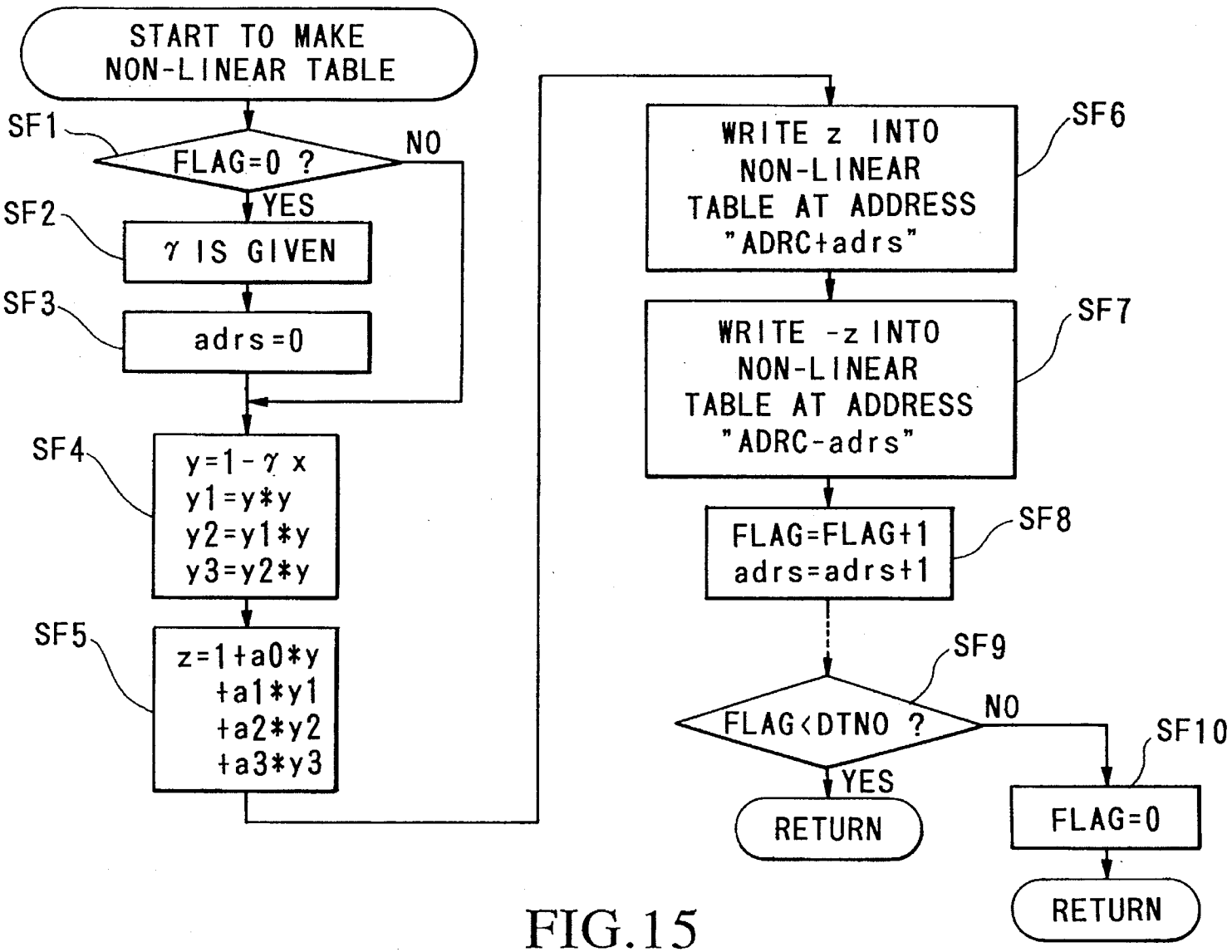
FIG. 15 is a flowchart showing processes which are required for performing an algorithm as shown in FIG. 14 when making a non-linear table.

FIG. 14 is a block diagram showing an algorithmic configuration which embodies an calculation represented by the equation (15). FIG. 15 is a flowchart showing a procedure by which the non-linear table is formed in accordance with the algorithm as shown in FIG. 14.

In first step SF1 in FIG. 15, it is judged whether or not the flag FLAG is set at "0". If a result of the judgement of step SF1 is "YES", the processing proceeds to step SF2 in which the coefficient γ is given from the computer externally provided. In next step SF3, the address variable adrs representing the write address for the non-linear table is set at "0".

If the judgement result of step SF1 is "NO", or when completing the process of step SF3, the processing proceeds to step SF4 in which a result of a calculation represented by an expression of "1–γx" is set as the variable y, while a result of a multiplication represented as "y*y" is set as a variable y1. Further, a result of a multiplication represented as "y1*y" is set as a variable y2, while a result of a multiplication represented as "y2*y" is set as a variable y3. In step SF5, a result of a calculation represented by a mathematical expression of "1+a0*y+a1*y1+a2*y2+a3*y3" is set as the variable z.

In step SF6, the above variable z is written into the nonlinear table at an address designated by a result of a calculation of "ADRC+adrs". Herein, a variable "ADRC" represents a start address for writing the data into the non-linear table. In step SF7, a negative value of the variable z, i.e., "–z", is written into the non-linear table at an address designated by a result of a calculation of "ADRC–adrs".

The above-mentioned processes of steps SF1 to SF8 are repeatedly performed in 1 DAC cycle. When completing the processes in 1 DAC cycle, the processing advances to step SF9 in which it is judged whether or not the flag FLAG is smaller than the variable DTNO representing the size of the non-linear table. If a result of the judgement of step SF9 is "NO", the processing proceeds to step SF10. In step SF10, the flag FLAG is set at "0" so as to declare that the predetermined calculations are completed. Then, the processing returns back to the main routine as shown in FIG. 5.

On the other hand, when the judgement result of step SF9 is "YES", it is indicated that the predetermined calculations are not completed. Thus, the processing directly returns back to the main routine without clearing the flag FLAG. Thereafter, when the processing returns to the routine shown in FIG. 15 again, the processes are performed on the basis of the value γ which is obtained by the process of step SF2. The processes are repeatedly performed until the judgement result of step SF9 turns to "NO".

By performing the above-mentioned arithmetical operations, the contents of the non-linear table (storing the functional results of the graham function) is rewritten in accordance with the algorithm as shown in FIG. 14.

② Method to make a non-linear table by the recurrence-formula technique

Next, the description will be given with respect to a method for performing the graham function utilizing the recurrence formula. It is difficult to obtain a solution for the aforementioned equation (2) directly by use of the recurrence formula. However, when comparing the functional curve shown in FIG. 12 with the functional curve shown in FIG. 24(A), it can be observed that the graham function may be approximated by use of the slit function as shown in FIG. 12, because these curves have a similarity. According to this approximation, the slit function is performed at first, and then, its functional results represented by the functional curve shown in FIG. 12 are symmetrically reversed with respect to y axis, thus approximately obtaining a solution for the graham function. Thus, it is possible to form the non-linear table corresponding to the graham function by use of the foregoing algorithms as shown in FIGS. 7 and 9. In this case, the same arithmetical operations are performed in accordance with the procedures represented by the flowcharts shown in FIGS. 8 and 10, hence, the detailed description thereof will be omitted.

(4) Other non-linear tables

When the other non-linear tables are required, the recurrence formulae as described below are respectively used for the algorithms.

① Sine function

The sine function is represented by a following equation:

$$y(x)=\sin \gamma\alpha/N \tag{16}$$

where $0 \leqq x \leqq 2\pi$ and N denotes a table size.

The recurrence formula for the equation (16) can be represented as follows:

$$y(n)=2\cdot\cos \alpha/N\cdot y(n-1)-y(n-2) \tag{17}$$

This formula (17) can be calculated with respect to n=0 and n=1 as follows:

$$y(0)=0, y(1)=\sin \alpha/N \tag{18}$$

Figure 16:
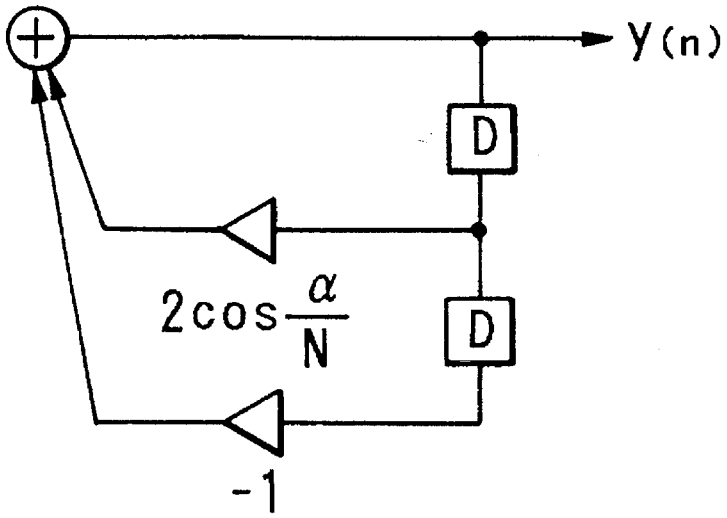
FIG. 16 is a block diagram showing an algorithmic configuration embodying a sine function.

FIG. 16 is a block diagram showing an algorithmic configuration embodying the above recurrence formula (17).

② Cosine function

The cosine function can be represented by a following equation:

$$y(x)=A\cdot\cos \alpha x \tag{19}$$

where $0 \leqq x \leqq 2\pi$ and N denotes a table size.

The recurrence formula for the above equation (19) can be represented as follows:

$$y(n)=2\cdot\cos \alpha/N\cdot y(n-1)-y(n-2) \tag{20}$$

This formula (20) can be calculated with respect to n=0 and n=1 as follows:

$$y(0)=1, y(1)=\cos (\alpha/N) \tag{21}$$

The same algorithmic configuration shown in FIG. 16 can be also employed for embodying the above recurrence formula (20) corresponding to the cosine function.

③ Combination of sine function and cosine function

A sum of values corresponding to the sine function and the cosine function can be represented by a following equation.

$$y(x)=\sum_{i=1}^{M1} A_i \sin\alpha_i x+\sum_{i=1}^{M2} B_i \cos\beta_i x \tag{22}$$

Figure 17:
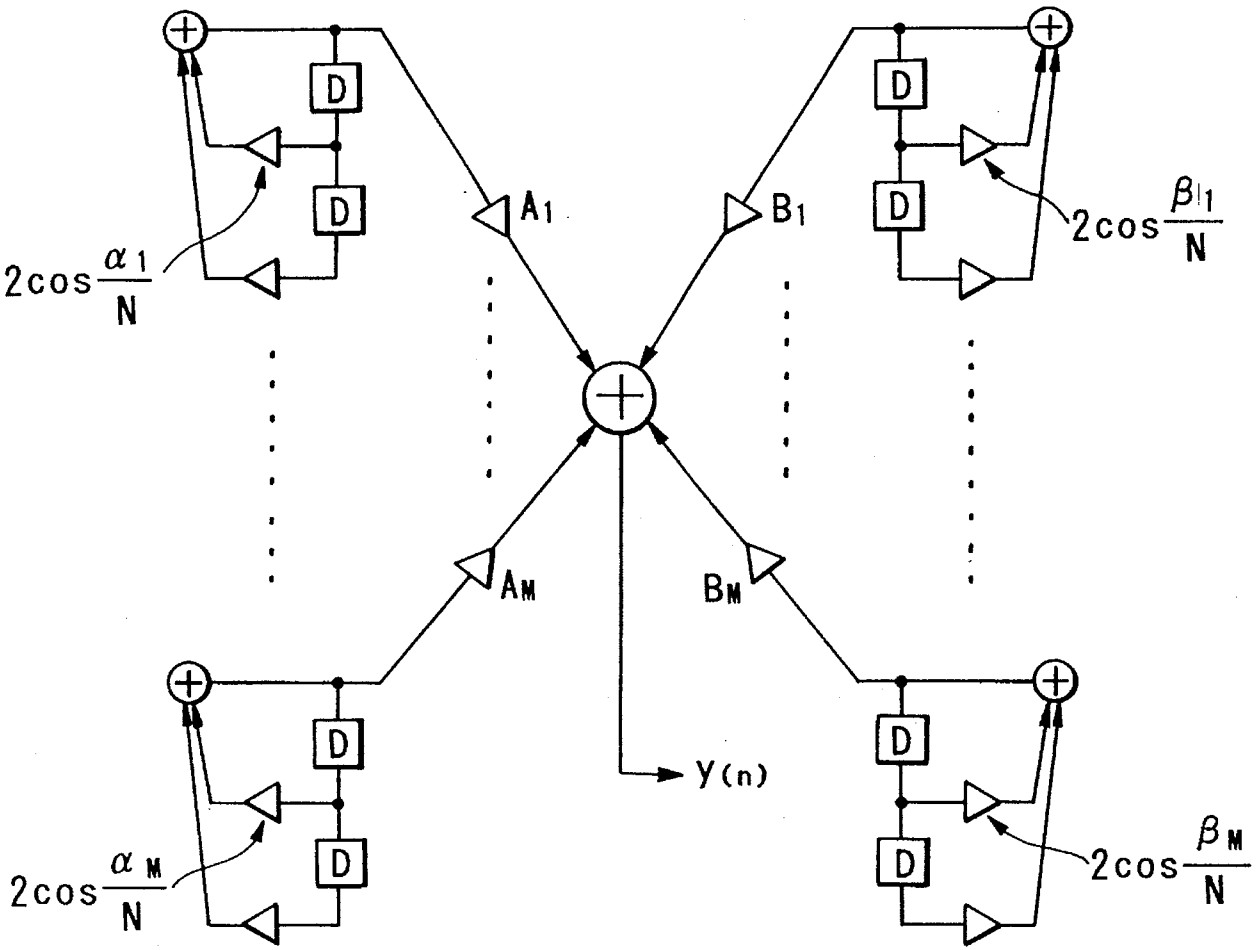
FIG. 17 is a block diagram showing an algorithmic configuration embodying a combination of a sine function and a cosine function.

The recurrence formula and the initial values (i.e., y(0) and y(1)) can be obtained from the above equation (22) as described before. An algorithmic configuration corresponding to this equation (22) is shown in FIG. 17. In this case, values $A_i$, $B_i$, $\alpha_i$ and $\beta_i$ can be assigned to manual-operable members in advance. Then, the contents of the non-linear table is rewritten by operating the manual-operable members, thus changing the tone color.

④ Low-pass filter

Figure 18:
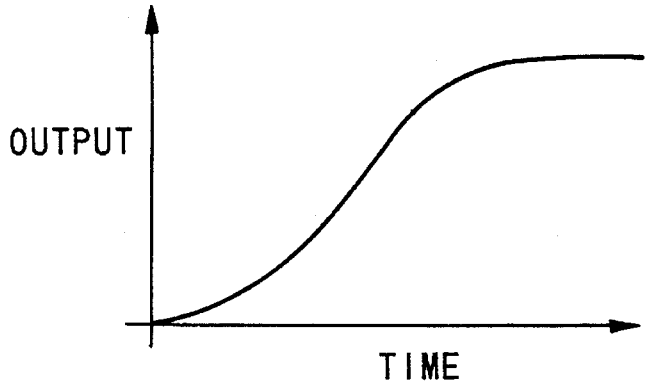
FIG. 18 is a graph showing a step-response characteristic of a second-order low-pass filter.
Figure 19:
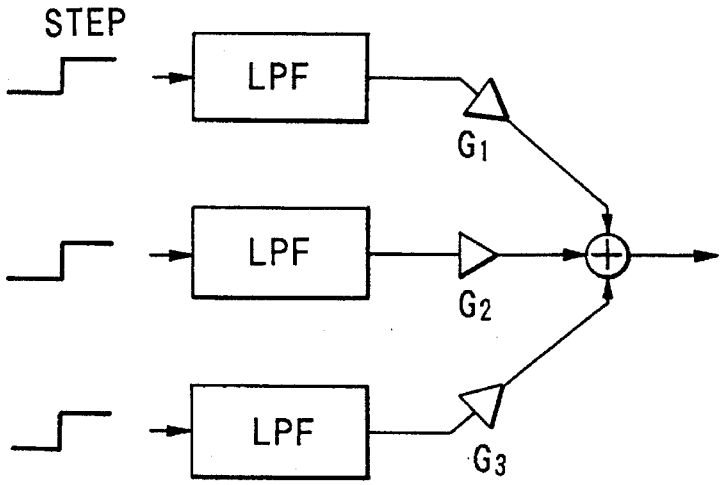
FIG. 19 is a block diagram showing an algorithmic configuration embodying a slit function which is performed by use of second-order low-pass filters.
Figure 20:
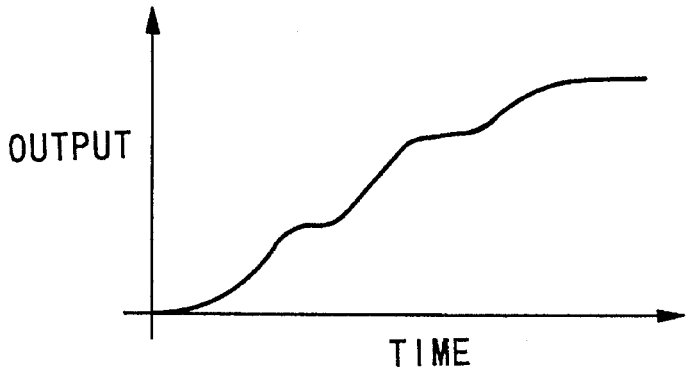
FIG. 20 is a graph showing a characteristic of an output of the algorithmic configuration shown in FIG. 19.

Next, an application to the low-pass filter will be described. Herein, a second-order low-pass filter having a step response characteristic as shown in FIG. 18 is chosen as an example. This low-pass filter is advantageous in that the slit function can be directly obtained in response to the step response characteristic. By combining the low-pass filters, it is possible to obtain a variety of slit functions. For example, three low-pass filters can be combined together as shown in FIG. 19. In this example, step-response signals outputted from the low-pass filters are respectively weighted by use of coefficients G1, G2 and G3, and then, they are added together. Thus, it is possible to obtain a step response characteristic as shown in FIG. 20. In this case, the above coefficients G1, G2 and G3 can be assigned to manual-operable members in advance. Then, by operating the manual-operable members, it is possible to change the tone color.

⑤ Numerical analysis method

It is possible to employ a so-called numerical analysis method as the method to make the non-linear table to be incorporated in the algorithmic procedure. In the calculation of the graham function, complicated calculations are not required but only a square root calculation is required (see a following equation (23)).

$$y(x)=\sqrt{x} \tag{23}$$

The above square root calculation can be approximately expressed by a following recurrence formula.

$$y_{n+1}=\tfrac{1}{2}(y_n+x/y_n) \tag{24}$$

where n=1, 2, 3, . . .

According to the above recurrence formula (24), a value of $y_n$ is converged to be equal to a square root of x. Thus, by repeatedly performing this calculation by a predetermined number of times which is allowed in 1 DAC cycle, it is possible to obtain the objective function.

In the aforementioned examples, it is necessary to change the parameter (e.g., $\gamma$ used in the equation (1), which is used for calculating out the non-linear values) in the following cases: i.e., a first case where the musical tones are created and a second case where the manual-operable members are operated. Herein, the above first case is not occurred frequently, therefore, the musical tones which are altered in real time can be obtained by the processing which is executed during several tens of DAC cycles. Even in the second case, a new parameter corresponding to the manual-operable member which is newly operated is transmitted to the present apparatus by every several milli-seconds based on the MIDI standard. Thus, the present apparatus can sufficiently respond to the variation of the parameter in real time.

Lastly, this invention may be practiced or embodied in still other ways without departing from the spirit or essential character thereof as described heretofore. Therefore, the preferred embodiment described herein is illustrative and not restrictive, the scope of the invention being indicated by the appended claims and all variations which come within the meaning of the claims are intended to be embraced therein.

What is claimed is:

1. A musical tone synthesizing apparatus comprising:

a first memory for storing a first procedure of instructions which is completely performed in a predetermined period;

a second memory for storing a second procedure of instructions which is completely performed during a plurality of predetermined periods, said instructions belonging to said second procedure being allocated to groups respectively so that each group of instructions is performed in each of said plurality of predetermined periods; and a processing means for performing a first kind of arithmetical operations in accordance with said first procedure of instructions, said first kind of arithmetical operations being repeatedly performed in each predetermined period, said processing means also performing a second kind of arithmetical operations in accordance with said second procedure of instructions, said second kind of arithmetical operations being completely performed during said plurality of predetermined periods, said first kind of arithmetical operations and a part of said second kind of arithmetical operations being performed in a time-division manner in each predetermined period, whereby said processing means eventually creates tone data in each predetermined period on the basis of results of said arithmetical operations, wherein said tone data represents a musical tone to be synthesized.

2. A musical tone synthesizing apparatus as defined in claim 1 wherein said first kind of arithmetical operations is provided to form said tone data representing the musical tone, while said second kind of arithmetical operations is provided to obtain information which is required when forming said tone data.

3. A musical tone synthesizing apparatus as defined in claim 1 wherein said processing means comprises a closed-loop means and an excitation means, said closed-loop means further comprising a delay means and a filter means, said delay means delaying an input signal thereof by a predetermined delay time, said filter means imparting a predetermined filter characteristic to an input signal thereof, said excitation means supplying an excitation signal to said closed-loop means so that said excitation signal circulates through said closed-loop means, from which a musical tone signal representing a synthesized musical tone is picked up, said closed-loop means and said excitation means being formed in accordance with said first procedure of instructions.

4. A musical tone synthesizing apparatus as defined in claim 3 wherein said processing means automatically creates a parameter in accordance with said second procedure of instructions, said parameter being used to alter a non-linear characteristic of said excitation means.

5. A musical tone synthesizing apparatus as defined in claim 3 wherein said processing means utilizing said closed-loop means and said excitation means simulates a sound-production mechanism.

6. A musical tone synthesizing apparatus comprising:

a non-linear table for storing results of algorithmic operations to be performed in advance, so that a contents of said non-linear table represents a non-linear characteristic of a musical instrument to be simulated;

a main memory for storing main instructions which are performed when forming musical tone signals representing: synthesized musical tones, said main instructions being completely performed in a predetermined;

a sub memory for storing sub instructions which are divided into a plurality of groups, so that each group of sub instructions is performed in each of a plurality of the predetermined periods, all of said sub instructions being completely performed in said plurality of predetermined periods; and a processing means for performing arithmetical operations in accordance with said main instructions in each predetermined period so as to form musical tone signals representing musical tones synthesized, said processing means also performing arithmetical operations in accordance with said sub instructions in each predetermined period so as to alter said non-linear characteristic of said non-linear table in real time.

* * * * *